US009904203B2

(12) United States Patent
Moriguchi

(10) Patent No.: US 9,904,203 B2
(45) Date of Patent: Feb. 27, 2018

(54) IMAGE FORMING APPARATUS AND IMAGE FORMING METHOD FOR CHARGING IMAGE CARRIER

(71) Applicant: KYOCERA Document Solutions Inc., Osaka-shi, Osaka (JP)

(72) Inventor: Kohei Moriguchi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/280,880

(22) Filed: Sep. 29, 2016

(65) Prior Publication Data

US 2017/0090335 A1 Mar. 30, 2017

(30) Foreign Application Priority Data

Sep. 30, 2015 (JP) ..... 2015-194322

(51) Int. Cl.
*G03G 15/02* (2006.01)

(52) U.S. Cl.
CPC ..... *G03G 15/0266* (2013.01)

(58) Field of Classification Search
USPC ..... 399/38, 50, 115, 130, 168, 174, 176
See application file for complete search history.

(56) References Cited

U.S. PATENT DOCUMENTS 7,907,854 B2 * 3/2011 Shima ..... G03G 15/0266 399/176

FOREIGN PATENT DOCUMENTS

JP 2003174767 A 6/2003

* cited by examiner

*Primary Examiner* — Hoan Tran
(74) *Attorney, Agent, or Firm* — Alleman Hall Creasman & Tuttle LLP

(57) ABSTRACT

This image forming apparatus includes an image carrier, a charging member, a capacitor, a voltage control portion, and a current conduction control portion. The charging member is configured to charge the image carrier. The capacitor is connected on a current conduction path connecting the charging member and a ground. The voltage control portion is configured to control whether or not to apply DC voltage to the charging member. The current conduction control portion is configured to make the current conduction path conductive after DC voltage is applied by the voltage control portion, and to disconnect the current conduction path before application of DC voltage by the voltage control portion is stopped.

5 Claims, 5 Drawing Sheets

IMAGE FORMING APPARATUS AND IMAGE FORMING METHOD FOR CHARGING IMAGE CARRIER

INCORPORATION BY REFERENCE

This application is based upon and claims the benefit of priority from the corresponding Japanese Patent Application No. 2015-194322 filed on Sep. 30, 2015, the entire contents of which are incorporated herein by reference.

BACKGROUND

The present disclosure relates to an image forming apparatus and an image forming method that are capable of forming an image in an electrophotographic manner.

In image forming apparatuses such as a printer capable of forming an image in an electrophotographic manner, the surface of an image carrier such as a photosensitive drum is charged and an electrostatic latent image is formed on the surface of the image carrier. For example, this type of image forming apparatus is provided with a charging member for charging the surface of the image carrier by DC voltage applied from a power supply.

By the way, in the image forming apparatus, the DC voltage applied to the charging member might pulsate. For example, in the image forming apparatus, in the case where superimposition voltage obtained by superimposing DC voltage and AC voltage is applied to a development member for developing an electrostatic latent image formed on the surface of the image carrier, the DC voltage applied to the charging member interferes with the superimposition voltage and thereby pulsates. If the DC voltage applied to the charging member pulsates, variations occur in the surface potential of the image carrier, whereby density unevenness occurs in an image formed on the surface of the image carrier. In this regard, technology of suppressing pulsation of DC voltage applied to the charging member, by connecting a capacitor connected to the ground, to the charging member, is known.

SUMMARY

An image forming apparatus according to one aspect of the present disclosure includes an image carrier, a charging member, a capacitor, a voltage control portion, and a current conduction control portion. The charging member is configured to charge the image carrier. The capacitor is connected on a current conduction path connecting the charging member and a ground. The voltage control portion is configured to control whether or not to apply DC voltage to the charging member. The current conduction control portion is configured to make the current conduction path conductive after DC voltage is applied by the voltage control portion, and to disconnect the current conduction path before application of DC voltage by the voltage control portion is stopped.

An image forming method according to another aspect of the present disclosure is executed by a processor provided in an image forming apparatus including: an image carrier; a charging member configured to charge the image carrier; and a capacitor connected on a current conduction path connecting the charging member and a ground. The image forming method includes a first step and a second step. In the first step, whether or not to apply DC voltage to the charging member is controlled. In the second step, the current conduction path is made conductive after DC voltage is applied in the first step, and the current conduction path is disconnected before application of DC voltage in the first step is stopped.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, with reference to the accompanying drawings, embodiments of the present disclosure will be described for understanding of the present disclosure. It is noted that the following embodiments are examples in which the present disclosure is embodied, and do not limit the technical scope of the present disclosure.

[Schematic Configuration of Image Forming Apparatus 10]

First, with reference to FIG. 1 and FIG. 2, the schematic configuration of an image forming apparatus 10 according to an embodiment of the present disclosure will be described. Here, FIG. 1 is a schematic sectional view showing the configuration of the image forming apparatus 10.

Figure 1:
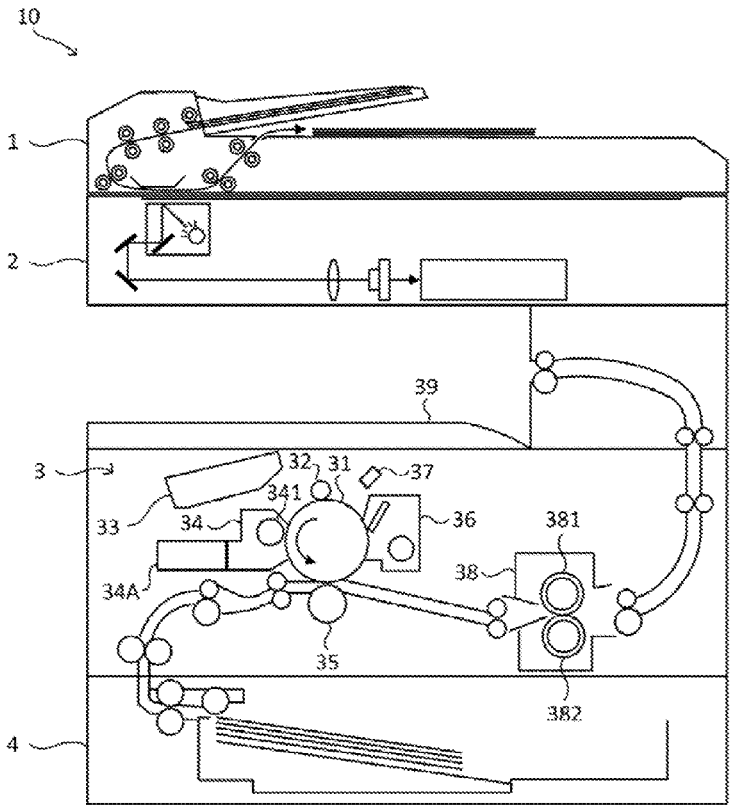
FIG. 1 is a diagram showing the configuration of an image forming apparatus according to an embodiment of the present disclosure.
Figure 2:
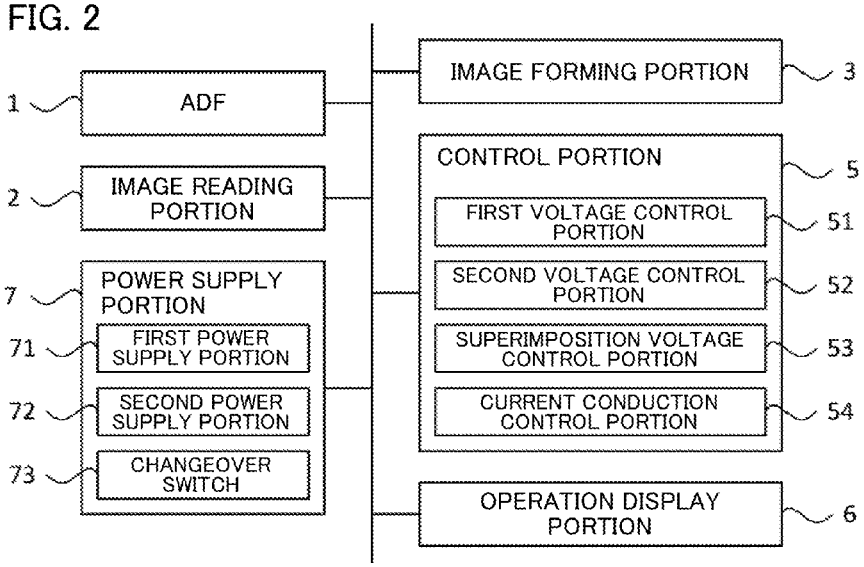
FIG. 2 is a block diagram showing the system configuration of the image forming apparatus according to the embodiment of the present disclosure.

As shown in FIG. 1 and FIG. 2, the image forming apparatus 10 includes an ADF 1, an image reading portion 2, an image forming portion 3, a sheet feed portion 4, a control portion 5, an operation display portion 6, and a power supply portion 7. The image forming apparatus 10 is a multifunction peripheral having a plurality of functions such as a facsimile function or a copy function as well as a scan function of reading image data from a document and a print function of forming an image on the basis of the image data. In addition, the present disclosure is applicable to image forming apparatuses such as a printer device, a facsimile device, and a copy machine.

The ADF 1 includes a document set portion, a plurality of conveyance rollers, a document holder, and a sheet discharge portion, and is an automatic document feeder which conveys a document to be read by the image reading portion 2. The image reading portion 2 includes a document table, a light source, a plurality of mirrors, an optical lens, and a CCD (Charge Coupled Device), and is capable of reading image data from a document.

The control portion 5 includes control devices such as a CPU, a ROM, a RAM, and an EEPROM (registered trademark), which are not shown. The CPU is a processor which executes various calculation processes. The ROM is a nonvolatile storage portion in which information such as a control program for causing the CPU to execute various processes is stored in advance. The RAM is a volatile storage portion used as a temporary storage memory (working area) for various processes to be executed by the CPU. The EEPROM is a nonvolatile storage portion. In the control portion 5, various control programs stored in advance in the ROM are executed by the CPU. Thus, the image forming apparatus 10 is comprehensively controlled by the control portion 5. It is noted that the control portion 5 may be configured from an electronic circuit such as an integrated circuit (ASIC), or may be a control portion provided separately from a main control portion for comprehensively controlling the image forming apparatus 10.

The operation display portion 6 has: a display portion such as a liquid crystal display which displays various information in accordance with a control command from the control portion 5; and an operation portion such as an operation key or a touch panel for inputting various information to the control portion 5 in accordance with a user's operation.

The image forming portion 3 is capable of executing an image forming process (printing process) for forming an image in an electrophotographic manner on the basis of image data read by the image reading portion 2 or image data inputted from an information processing device such as an external personal computer.

Specifically, as shown in FIG. 1, the image forming portion 3 includes a photosensitive drum 31, a charging member 32, a light scanning unit 33, a developing device 34, a transfer roller 35, a cleaning device 36, an electricity removing device 37, a fixing device 38, and a sheet discharge tray 39.

The photosensitive drum 31 allows an electrostatic latent image to be formed on the surface thereof. For example, the photosensitive drum 31 is formed by coating the surface of an element tube made of aluminum, with an organic photosensitive material composed of an organic compound that improves electric conductivity when being irradiated with light. Here, the photosensitive drum 31 is an example of an image carrier in the present disclosure.

The charging member 32 charges the surface of the photosensitive drum 31. For example, the charging member 32 is a roller member provided in contact with the surface of the photosensitive drum 31. DC voltage is applied to the charging member 32 from a first power supply portion 71 described later. Thus, discharge occurs between the charging member 32 and the photosensitive drum 31, whereby the surface of the photosensitive drum 31 is charged. It is noted that the charging member 32 may be a member provided in a contactless manner with the surface of the photosensitive drum 31.

The light scanning unit 33 forms an electrostatic latent image on the surface of the photosensitive drum 31. Specifically, the light scanning unit 33 applies light based on image data to the surface of the photosensitive drum 31 charged by the charging member 32.

The developing device 34 develops the electrostatic latent image formed on the surface of the photosensitive drum 31, using toner. Specifically, the developing device 34 includes a development member 341 which supplies toner to the surface of the photosensitive drum 31. For example, the development member 341 is cylindrical shape and rotatable a roller member provided away from the surface of the photosensitive drum 31. Superimposition voltage obtained by superimposing DC voltage and AC voltage is applied to the development member 341 from a second power supply portion 72 described later. Thus, an electric field is formed between the development member 341 and the photosensitive drum 31, and toner is supplied from the development member 341 to the surface of the photosensitive drum 31. It is noted that the developing device 34 is supplied with toner (developer) from a toner container 34A attachable to and detachable from the image forming portion 3.

The transfer roller 35 transfers a toner image formed on the surface of the photosensitive drum 31 by the developing device 34, to a sheet fed from the sheet feed portion 4. The superimposition voltage obtained by superimposing DC voltage and AC voltage is applied to the transfer roller 35 from a power supply device (not shown). Thus, an electric field is formed between the transfer roller 35 and the photosensitive drum 31, and the toner image formed on the surface of the photosensitive drum 31 is transferred to the sheet.

The cleaning device 36 cleans the surface of the photosensitive drum 31 after the toner image is transferred by the transfer roller 35. For example, the cleaning device 36 includes: a blade-like cleaning member which removes the remaining toner on the surface of the photosensitive drum 31; and a conveyance screw which conveys the toner removed by the cleaning member to a toner storage case (not shown).

The electricity removing device 37 applies light to the surface of the photosensitive drum 31, to remove the remaining charge on the surface of the photosensitive drum 31.

The fixing device 38 melts and fixes, on the sheet, the toner image transferred to the sheet by the transfer roller 35. For example, the fixing device 38 includes a fixing roller 381 and a pressure roller 382. The fixing roller 381 is provided in contact with the pressure roller 382, and heats the toner image transferred to the sheet, to fix the toner image on the sheet. The pressure roller 382 pressurizes the sheet passing through a contact part formed between the pressure roller 382 and the fixing roller 381.

The sheet on which the toner image is fixed by the fixing device 38 is discharged to the sheet discharge tray 39.

In the image forming portion 3, an image is formed on a sheet fed from a sheet feed cassette attachable to and detachable from the sheet feed portion 4, through the following procedure, and the sheet after the image formation is discharged to the sheet discharge tray 39. It is noted that the sheet is a sheet material such as paper, coated paper, a postcard, an envelope, or an OHP sheet.

First, the surface of the photosensitive drum 31 is uniformly charged at a predetermined potential by the charging member 32. Next, the light scanning unit 33 applies light based on image data to the surface of the photosensitive drum 31. Thus, an electrostatic latent image corresponding to the image data is formed on the surface of the photosensitive drum 31. Then, the electrostatic latent image on the photosensitive drum 31 is developed (visualized) as a toner image with toner supplied from the development member 341 of the developing device 34.

Subsequently, the toner image formed on the photosensitive drum 31 is transferred to the sheet by the transfer roller 35. Thereafter, the toner image transferred to the sheet is heated by the fixing roller 381 to be melted and fixed, while the sheet is passing between the fixing roller 381 and the pressure roller 382 of the fixing device 38. It is noted that the remaining toner on the surface of the photosensitive drum 31 is removed by the cleaning device 36. In addition, the remaining charge on the surface of the photosensitive drum 31 is removed by light applied from the electricity removing device 37.

By the way, DC voltage applied to the charging member 32 might pulsate. For example, the DC voltage applied to the charging member 32 interferes with the superimposition voltage applied to the development member 341 and thereby pulsates. If the DC voltage applied to the charging member 32 pulsates, variations occur in the surface potential of the photosensitive drum 31, whereby density unevenness occurs in an image formed on the surface of the photosensitive drum 31. In this regard, technology of suppressing pulsation of the DC voltage applied to the charging member 32, by connecting a capacitor connected to the ground, to the charging member 32, is known.

However, in the above technology, even if DC voltage is applied to the charging member 32, charging by the charging member 32 is not performed until the capacitor is charged, and thus start of the printing process might be delayed. In addition, in the above technology, even if application of DC voltage to the charging member 32 is stopped, charging by the charging member 32 continues until discharge from the capacitor is finished, and thus deterioration of the photosensitive drum 31 progresses. On the other hand, the image forming apparatus 10 according to the embodiment of the present disclosure can suppress delay of start of the printing process and suppress deterioration of the photosensitive drum 31, as described below.

Figure 3:
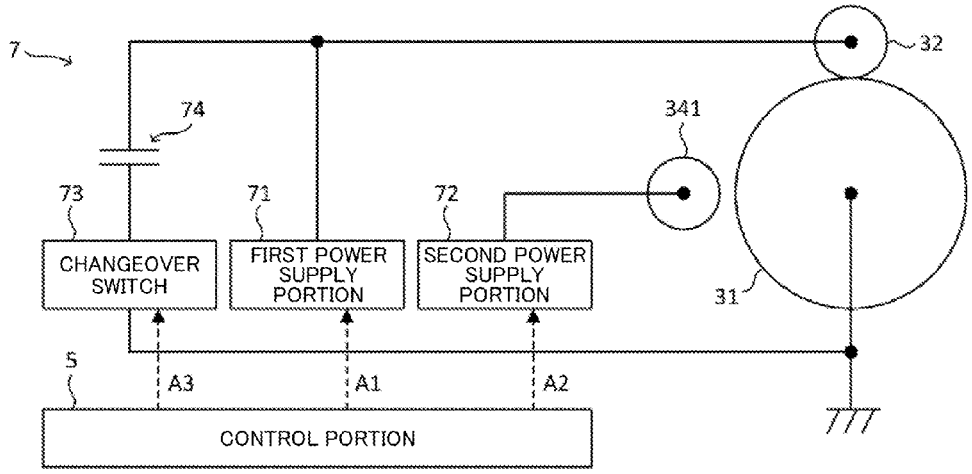
FIG. 3 is a diagram showing the configuration of a power supply portion of the image forming apparatus according to the embodiment of the present disclosure.

Hereinafter, with reference to FIG. 2 and FIG. 3, the power supply portion 7 will be described. FIG. 3 is a block diagram showing the configuration of the power supply portion 7.

As shown in FIG. 3, the power supply portion 7 includes a first power supply portion 71, a second power supply portion 72, a changeover switch 73, and a capacitor 74.

The first power supply portion 71 is a voltage source for applying DC voltage to the charging member 32. The first power supply portion 71 applies DC voltage to the charging member 32 in accordance with a control signal A1 (see FIG. 3) inputted from the control portion 5. For example, the first power supply portion 71 includes an amplification circuit, a step-up circuit, a rectification circuit, and the like, and generates DC voltage to be applied to the charging member 32, on the basis of the control signal A1.

The second power supply portion 72 is a voltage source for applying the superimposition voltage obtained by superimposing DC voltage and AC voltage, to the development member 341. The second power supply portion 72 applies the superimposition voltage to the development member 341 in accordance with a control signal A2 (see FIG. 3) inputted from the control portion 5. For example, the second power supply portion 72 includes an amplification circuit, a step-up circuit, a rectification circuit, and the like, and generates the DC voltage on the basis of the control signal A2. The second power supply portion 72 superimposes the generated DC voltage and AC voltage generated by an AC voltage source, to generate the superimposition voltage.

As shown in FIG. 3, the capacitor 74 is connected on a current conduction path connecting the charging member 32 and the ground. The capacitor 74 absorbs, through charging and discharging, pulsation of DC voltage applied to the charging member 32 by the first power supply portion 71. For example, DC voltage applied to the charging member 32 by the first power supply portion 71 interferes with the superimposition voltage applied to the development member 341 and thereby pulsates. In addition, it is also conceivable that DC voltage applied to the charging member 32 by the first power supply portion 71 interferes with the superimposition voltage applied to the transfer roller 35 and thereby pulsates.

As shown in FIG. 3, the changeover switch 73 is provided on the current conduction path connecting the charging member 32 and the ground, and can switch the current conduction path between a conductive state and a nonconductive state. For example, the changeover switch 73 is a transistor switch which makes the current conduction path conductive in accordance with the control signal A3 inputted from the control portion 5. It is noted that the changeover switch 73 may be a relay circuit or the like.

In the ROM of the control portion 5, a voltage control program for causing the CPU to execute a second voltage control process (see flowchart in FIG. 4) and a first voltage control process (see flowchart in FIG. 5) described later is stored in advance. It is noted that the voltage control program may be stored in a non-transitory computer-readable storage medium such as a CD, a DVD, or a flash memory, and may be read from the storage medium, to be installed onto the storage portion such as the EEPROM in the control portion 5.

As shown in FIG. 2, the control portion 5 includes a first voltage control portion 51, a second voltage control portion 52, a superimposition voltage control portion 53, and a current conduction control portion 54. Specifically, the control portion 5 executes the voltage control program stored in the ROM, using the CPU. Thus, the control portion 5 functions as the first voltage control portion 51, the second voltage control portion 52, the superimposition voltage control portion 53, and the current conduction control portion 54.

The first voltage control portion 51 applies DC voltage to the charging member 32 when the printing process is executed in the image forming apparatus 10. Specifically, the first voltage control portion 51 inputs the control signal A1 to the first power supply portion 71 to cause the first power supply portion 71 to start application of DC voltage to the charging member 32. In addition, the first voltage control portion 51 stops input of the control signal A1 to the first power supply portion 71 to cause the first power supply portion 71 to stop application of DC voltage to the charging member 32.

The second voltage control portion 52 applies DC voltage to the charging member 32 at a predetermined timing except when the printing process is executed in the image forming apparatus 10. For example, the predetermined timing is a time at which the image forming apparatus 10 is powered on, a time at which the image forming apparatus 10 returns to a normal operation state from a sleep state in which a part of the function thereof is stopped, a time at which a predetermined time has elapsed since the last printing process has finished, or the like.

Specifically, the second voltage control portion 52 controls whether or not to apply DC voltage to the charging member 32 by the first power supply portion 71, using the control signal A1, as in the first voltage control portion 51.

Here, the first voltage control portion 51 and the second voltage control portion 52 are an example of a voltage control portion in the present disclosure.

The superimposition voltage control portion 53 applies the superimposition voltage obtained by superimposing DC voltage and AC voltage, to the development member 341, after DC voltage is applied to the charging member 32 by the first voltage control portion 51. Specifically, the superimposition voltage control portion 53 inputs the control signal A2 to the second power supply portion 72 to cause the second power supply portion 72 to start application of the superimposition voltage to the development member 341. In addition, the superimposition voltage control portion 53 stops input of the control signal A2 to the second power supply portion 72 to cause the second power supply portion 72 to stop application of the superimposition voltage to the development member 341.

In the case where DC voltage is applied by the first voltage control portion 51, the current conduction control portion 54 causes the current conduction path connecting the charging member 32 and the ground to be conductive after DC voltage is applied by the first voltage control portion 51, and disconnects the current conduction path before application of DC voltage by the first voltage control portion 51 is stopped.

On the other hand, in the case where DC voltage is applied by the second voltage control portion 52, the current conduction control portion 54 makes the current conduction path conductive before DC voltage is applied by the second voltage control portion 52, and disconnects the current conduction path before application of DC voltage by the second voltage control portion 52 is stopped.

In addition, the current conduction control portion 54 makes the current conduction path conductive before the superimposition voltage is applied by the superimposition voltage control portion 53.

Specifically, the current conduction control portion 54 inputs the control signal A3 to the changeover switch 73 to cause the changeover switch 73 to make the current conduction path conductive. In addition, the current conduction control portion 54 stops input of the control signal A3 to the changeover switch 73 to cause the changeover switch 73 to disconnect the current conduction path.

In the image forming apparatus 10, the second voltage control process described below is executed, whereby the capacitor 74 is charged in advance before execution of the printing process. In addition, in the image forming apparatus 10, the first voltage control process described later is executed, whereby discharge of the capacitor 74 upon finish of the printing process is restricted.

[Second Voltage Control Process]

Figure 4:
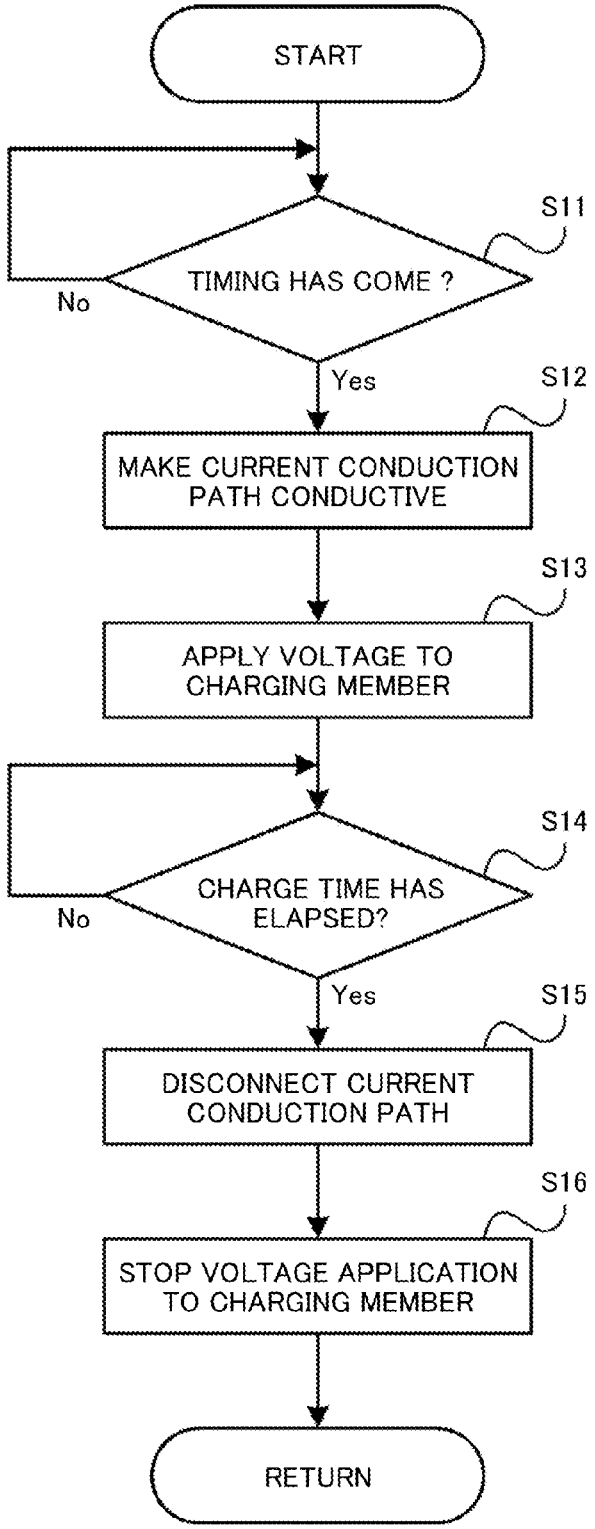
FIG. 4 is a flowchart showing an example of a second voltage control process executed by the image forming apparatus according to the embodiment of the present disclosure.

Next, with reference to FIG. 4, an example of the procedure of the second voltage control process executed by the control portion 5 in the image forming apparatus 10 will be described. Here, steps S11, S12, . . . denote the numbers of steps in the processing procedure executed by the control portion 5.

<Step S11>

First, in step S11, the control portion 5 determines whether or not the predetermined timing has come.

Here, if the control portion 5 determines that the predetermined timing has come (Yes in S11), the control portion 5 shifts the process to step S12. In addition, if the predetermined timing has not come yet (No in S11), the control portion 5 waits until the predetermined timing comes in step S11.

<Step S12>

In step S12, the control portion 5 causes the current conduction path connecting the charging member 32 and the ground to be conductive. Specifically, the control portion 5 inputs the control signal A3 to the changeover switch 73 to cause the changeover switch 73 to make the current conduction path conductive. Here, the processing of step S12 is executed by the current conduction control portion 54 of the control portion 5.

<Step S13>

In step S13, the control portion 5 applies DC voltage to the charging member 32. Specifically, the control portion 5 inputs the control signal A1 to the first power supply portion 71 to cause the first power supply portion 71 to start application of DC voltage to the charging member 32. Here, the processing of step S13 is executed by the second voltage control portion 52 of the control portion 5.

Here, in the second voltage control process, the current conduction path is made conductive before the DC voltage is applied to the charging member 32. Thus, it becomes possible to avoid occurrence of unnecessary discharge between the charging member 32 and the photosensitive drum 31. It is noted that, in the second voltage control process, the processing order of step S12 and step S13 may be reversed. In this case, it is conceivable that, while the photosensitive drum 31 is rotated, the electricity removing device 37 is lit to remove the charge accumulated on the surface of the photosensitive drum 31 due to discharge occurring between the charging member 32 and the photosensitive drum 31.

<Step S14>

In step S14, the control portion 5 determines whether or not a predetermined charge time has elapsed since application of DC voltage to the charging member 32 has been started in step S13. Here, the charge time is a time needed for charging the capacitor 74 with current supplied from the first power supply portion 71.

Here, if the control portion 5 determines that the charge time has elapsed since the application of DC voltage to the charging member 32 has been started in step S13 (Yes in S14), the control portion 5 shifts the process to step S15. On the other hand, if the charge time has not elapsed yet (No in S14), the control portion 5 waits until the charge time elapses in step S14.

<Step S15>

In step S15, the control portion 5 disconnects the current conduction path. Specifically, the control portion 5 stops input of the control signal A3 to the changeover switch 73 to cause the changeover switch 73 to disconnect the current conduction path. Here, the processing of step S15 is executed by the current conduction control portion 54 of the control portion 5.

<Step S16>

In step S16, the control portion 5 stops application of DC voltage to the charging member 32. Specifically, the control portion 5 stops input of the control signal A1 to the first power supply portion 71 to cause the first power supply portion 71 to stop application of DC voltage to the charging member 32. Here, the processing of step S16 is executed by the second voltage control portion 52 of the control portion 5.

Here, in the second voltage control process, the current conduction path is disconnected before application of DC voltage to the charging member 32 is stopped. Thus, discharge of the capacitor 74 to be caused after application of DC voltage to the charging member 32 is stopped is restricted.

[First Voltage Control Process]

Figure 5:
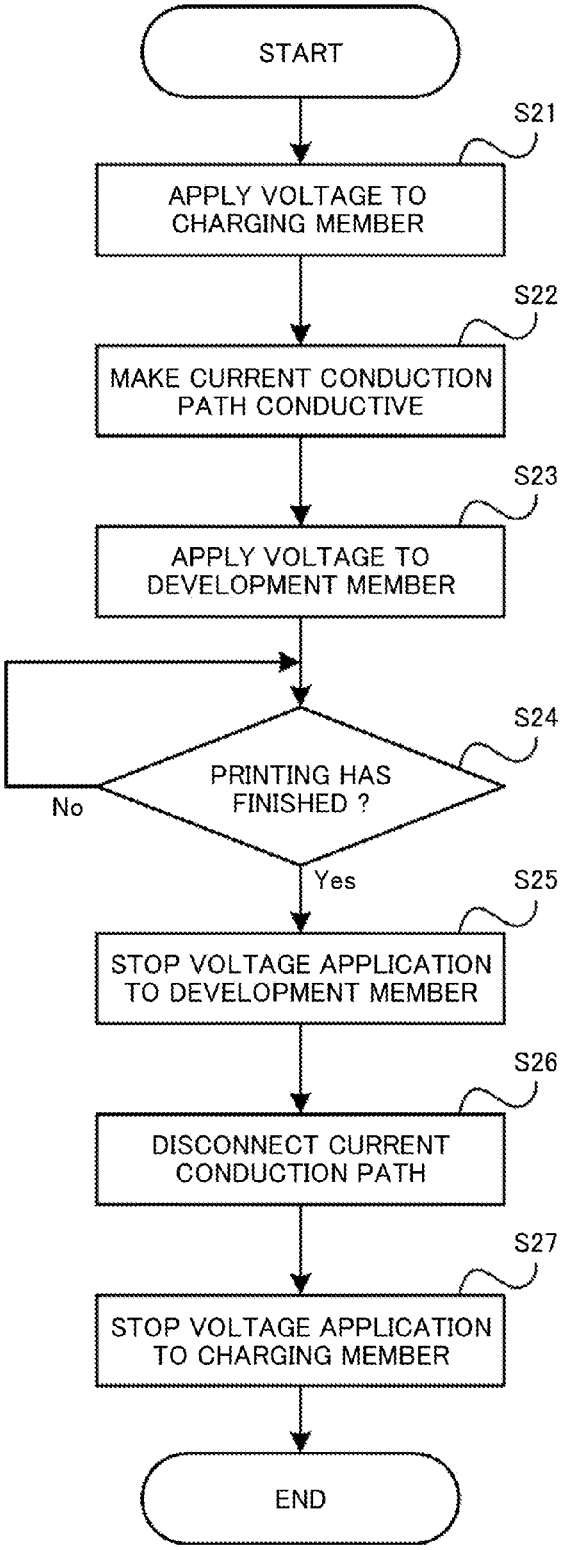
FIG. 5 is a flowchart showing an example of a first voltage control process executed by the image forming apparatus according to the embodiment of the present disclosure.
Figure 6:
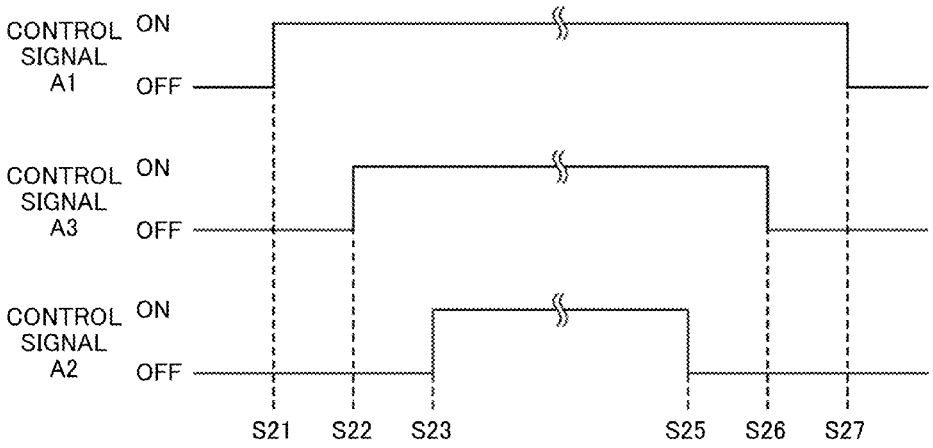
FIG. 6 is a diagram showing output timings of control signals outputted from a control portion of the image forming apparatus according to the embodiment of the present disclosure.

Next, with reference to FIG. 5 and FIG. 6, an example of the procedure of the first voltage control process executed by the control portion 5 in the image forming apparatus 10 will be described. FIG. 6 is a timing chart showing output timings of the control signals A1 to S3 to be outputted from the control portion 5 in execution of each step in the first voltage control process. Here, the first voltage control process is executed together with the printing process in the case where the printing process is executed in the image forming apparatus 10.

<Step S21>

In step S21, the control portion 5 applies DC voltage to the charging member 32. Specifically, the control portion 5 outputs the control signal A1 to cause the first power supply portion 71 to start application of the DC voltage to the charging member 32. Here, the processing of step S21 is executed by the first voltage control portion 51 of the control portion 5.

<Step S22>

In step S22, the control portion 5 causes the current conduction path connecting the charging member 32 and the ground to be conductive. Specifically, the control portion 5 outputs the control signal A3 to cause the changeover switch 73 to make the current conduction path conductive. Here, the processing of step S22 is executed by the current conduction control portion 54 of the control portion 5.

Here, in the image forming apparatus 10, the second voltage control process is executed before execution of the printing process, whereby the capacitor 74 is charged in advance. Therefore, even if the current conduction path is made conductive, the amount of current supplied from the first power supply portion 71 to the charging member 32 does not decrease.

<Step S23>

In step S23, the control portion 5 applies the superimposition voltage to the development member 341. Specifically, the control portion 5 outputs the control signal A2 to cause the second power supply portion 72 to start application of the superimposition voltage to the development member 341. Here, the processing of step S23 is executed by the superimposition voltage control portion 53 of the control portion 5.

Here, in the image forming apparatus 10, the current conduction path is made conductive before the superimposition voltage is applied to the development member 341. Thus, even if the DC voltage applied to the charging member 32 by the first power supply portion 71 interferes with the superimposition voltage applied to the development member 341 and thereby pulsates, the pulsation is absorbed by the capacitor 74.

<Step S24>

In step S24, the control portion 5 determines whether or not the printing process has finished.

Here, if the control portion 5 determines that the printing process has finished (Yes in S24), the control portion 5 shifts the process to step S25. On the other hand, if the printing process has not finished yet (No in S24), the control portion 5 waits until the printing process finishes in step S24.

<Step S25>

In step S25, the control portion 5 stops application of the superimposition voltage to the development member 341. Specifically, the control portion 5 stops output of the control signal A2 to cause the second power supply portion 72 to stop application of the superimposition voltage to the development member 341. Here, the processing of step S25 is executed by the superimposition voltage control portion 53 of the control portion 5.

<Step S26>

In step S26, the control portion 5 disconnects the current conduction path. Specifically, the control portion 5 stops output of the control signal A3 to cause the changeover switch 73 to disconnect the current conduction path. Here, the processing of step S22 and step S26 is an example of a second step in the present disclosure, and is executed by the current conduction control portion 54 of the control portion 5.

<Step S27>

In step S27, the control portion 5 stops application of DC voltage to the charging member 32. Specifically, the control portion 5 stops output of the control signal A1 to cause the first power supply portion 71 to stop application of DC voltage to the charging member 32. Here, the processing of step S21 and step S27 is an example of a first step in the present disclosure, and is executed by the first voltage control portion 51 of the control portion 5.

Here, in the first voltage control process, the current conduction path is disconnected before application of DC voltage to the charging member 32 is stopped, as in the second voltage control process. Thus, discharge of the capacitor 74 to be caused after application of DC voltage to the charging member 32 is stopped is restricted.

Thus, in the image forming apparatus 10, the first voltage control process is executed, whereby discharge of the capacitor 74 upon finish of the printing process is restricted. Thus, deterioration of the photosensitive drum 31 due to discharge of the capacitor 74 to be caused upon finish of the printing process is suppressed. In addition, a charging process for the capacitor 74 at the start of the printing process is omitted, whereby delay of start of the printing process is suppressed.

In addition, in the image forming apparatus 10, the second voltage control process is executed, whereby the capacitor 74 is charged in advance before execution of the printing process. Thus, in the printing process to be executed for the first time after the image forming apparatus 10 is powered on, after the image forming apparatus 10 returns to a normal operation state from a sleep state in which a part of the function thereof is stopped, or after a predetermined time has elapsed since the last printing process has finished, the charging process for the capacitor 74 is omitted, whereby delay of start of the printing process is suppressed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image carrier;

a charging member configured to charge the image carrier;

a capacitor connected on a current conduction path connecting the charging member and a ground;

a voltage control portion configured to control whether or not to apply DC voltage to the charging member;

a current conduction control portion configured to make the current conduction path conductive after DC voltage is applied by the voltage control portion, and to disconnect the current conduction path before application of DC voltage by the voltage control portion is stopped;

a development member configured to develop an electrostatic latent image formed on the image carrier; and a superimposition voltage control portion configured to apply superimposition voltage obtained by superimposing DC voltage and AC voltage, to the development member, after DC voltage is applied to the charging member by the voltage control portion, wherein the current conduction control portion makes the current conduction path conductive before the superimposition voltage is applied by the superimposition voltage control portion.

2. The image forming apparatus according to claim 1, further comprising a changeover switch provided on the current conduction path and capable of switching the current conduction path between a conductive state and a nonconductive state, wherein the current conduction control portion controls the changeover switch to switch the current conduction path between a conductive state and a nonconductive state.

3. An image forming method to be executed by a processor provided in an image forming apparatus including: an image carrier; a charging member configured to charge the image carrier; a capacitor connected on a current conduction path connecting the charging member and a ground; and a development member configured to develop an electrostatic latent image formed on the image carrier, the image forming method comprising:

a first step of controlling whether or not to apply DC voltage to the charging member;

a second step of making the current conduction path conductive after DC voltage is applied in the first step, and disconnecting the current conduction path before application of DC voltage in the first step is stopped; and a third step of applying a superimposition voltage obtained by superimposing DC voltage and AC voltage to the development member after DC voltage is applied to the charging member in the first step, wherein in the second step, the current conduction path is made conductive before the superimposition voltage is applied in the third step.

4. An image forming apparatus comprising:

an image carrier;

a charging member configured to charge the image carrier;

a capacitor connected on a current conduction path connecting the charging member and a ground;

a voltage control portion configured to control whether or not to apply DC voltage to the charging member; and a current conduction control portion configured to make the current conduction path conductive after DC voltage is applied by the voltage control portion, and to disconnect the current conduction path before application of DC voltage by the voltage control portion is stopped, wherein the voltage control portion includes: a first voltage control portion configured to apply DC voltage to the charging member when a printing process is executed in the image forming apparatus; and a second voltage control portion configured to apply DC voltage to the charging member at a predetermined timing except when the printing process is executed, and in a case where DC voltage is applied by the first voltage control portion, the current conduction control portion makes the current conduction path conductive after DC voltage is applied by the first voltage control portion, and in a case where DC voltage is applied by the second voltage control portion, the current conduction control portion makes the current conduction path conductive before DC voltage is applied by the second voltage control portion.

5. The image forming apparatus according to claim 4, further comprising a changeover switch provided on the current conduction path and capable of switching the current conduction path between a conductive state and a nonconductive state, wherein the current conduction control portion controls the changeover switch to switch the current conduction path between a conductive state and a nonconductive state.

* * * * *